United States Patent [19]

Hall

[11] Patent Number: 4,991,233

[45] Date of Patent: Feb. 12, 1991

[54] GARMENT WITH INDICIA

[76] Inventor: Andrew Hall, P.O. Box 15183, Jersey City, N.J. 07305-5147

[21] Appl. No.: 89,062

[22] Filed: Aug. 27, 1987

[51] Int. Cl.[5] ..... A41B 1/18

[52] U.S. Cl. ..... 2/115; 2/118; 2/DIG. 6; 40/586

[58] Field of Search ..... 2/DIG. 6, 46, 48, 115, 2/118, 119, 244, 246, 69; 40/586

[56] References Cited

U.S. PATENT DOCUMENTS

| | | | |
|---|---|---|---|
| D. 234,235 | 2/1975 | Nally . | |
| D. 246,942 | 1/1978 | Popiela . | |
| D. 255,169 | 6/1980 | McCue . | |
| D. 272,389 | 1/1984 | Meade . | |
| D. 286,220 | 10/1986 | Irwin . | |
| 301,260 | 7/1884 | Plant | 2/118 |
| 373,243 | 11/1887 | Miller | 40/486 |
| 807,635 | 12/1905 | Neal | 40/486 |
| 2,527,258 | 10/1950 | Kahn . | |
| 2,647,261 | 8/1953 | Rassner . | |
| 2,685,690 | 8/1954 | Chrisman . | |
| 3,825,954 | 7/1974 | Naumovski | 2/115 |
| 4,079,465 | 3/1978 | Alexander . | |
| 4,120,053 | 10/1978 | Nemirofsky . | |
| 4,202,053 | 5/1980 | Bell . | |
| 4,266,299 | 5/1981 | Beal . | |
| 4,277,848 | 7/1981 | Boehland . | |
| 4,296,498 | 10/1981 | Vinson . | |
| 4,432,513 | 2/1984 | Yost | 2/DIG. 6 X |
| 4,453,274 | 6/1984 | Allen . | |
| 4,466,136 | 8/1984 | Bottom et al. . | |
| 4,513,451 | 4/1985 | Brown | 2/115 |
| 4,627,110 | 12/1986 | Tengs . | |
| 4,660,226 | 4/1987 | Quilling et al. . | |
| 4,710,981 | 12/1987 | Sanchez | 2/115 |

*Primary Examiner*—Werner H. Schroeder
*Attorney, Agent, or Firm*—Millen, White & Zelano

[57] ABSTRACT

A shirt is configured as a novelty item and includes first and second indicia on the front panel thereof wherein the indicia are related to one another in meaning. The second indicia is covered by a flap which is readily movable by a person other than the wearer of the shirt to expose the second indicia.

8 Claims, 1 Drawing Sheet

GARMENT WITH INDICIA

BACKGROUND OF THE INVENTION

The instant invention relates to garments with indicia thereon. More particularly, the instant invention relates to garments having indicia thereon wherein the garments are primarily novelty items.

Garments are frequently used to display indicia in order to convey messages such as advertisements for products and services, cultural and political slogans and just about any message that a person may be interested in displaying. For example, U.S. Pat. Nos. 2,685,690 and 2,527,258 each disclose garments with detachable panels wherein the panels have advertising information thereon. U.S. Pat. No. 4,627,110 discloses a shirt with a panel having an erasable writing surface, while U.S. Pat. No. 4,120,053 discloses a shirt which actually dispenses various items pictorially illustrated on the garment. Athletic jerseys with flaps for changing indicia are disclosed in U.S. Pat. Nos. 4,.277,848 and 4,296,498.

Lately, an enormous market has developed for sweatshirts and T-shirts which display slogans and other indicia which the wearer hopefully believes will attract attention or admiration. While the sales of such garments have soared, the structure of the garments has remained substantially the same. These garments are essentially novelty items, but their novelty is limited to the message which is at all times visible on the garment.

SUMMARY OF THE INVENTION

It is an object of the instant invention to provide a garment such as a shirt which provides a novel structure for displaying information. With this object and other objects in mind, the instant invention contemplates a garment having first and second sections, each of which have indicia thereon, with the indicia of the second section having some relationship to the indicia of the first section. The second section is normally covered by a movable panel or the like, which movable panel preferably has an instruction thereon suggesting that another person remove the panel so as to expose the indicia concealed therebehind.

In accordance with one embodiment of the invention, the garment is a shirt, the first section of which has an inquiry thereon and the second section of which has an answer to the inquiry. The moveable panel overlies and conceals the answer, while the instruction on the panel suggests that the panel be "pulled" in order to expose the answer. In accordance with even a more specific embodiment of the invention, the panel has upper and lower edges with the lower edge being stitched to the shirt and the upper edge being detachably secured to the shirt with VELCRO fasteners or the like. A lanyard is attached to the panel adjacent the upper edge thereof for a person other than the wearer of the shirt to pull and thereby expose the answer concealed behind the panel.

DESCRIPTION OF THE PREFERRED EMBODIMENT

Figure 1:
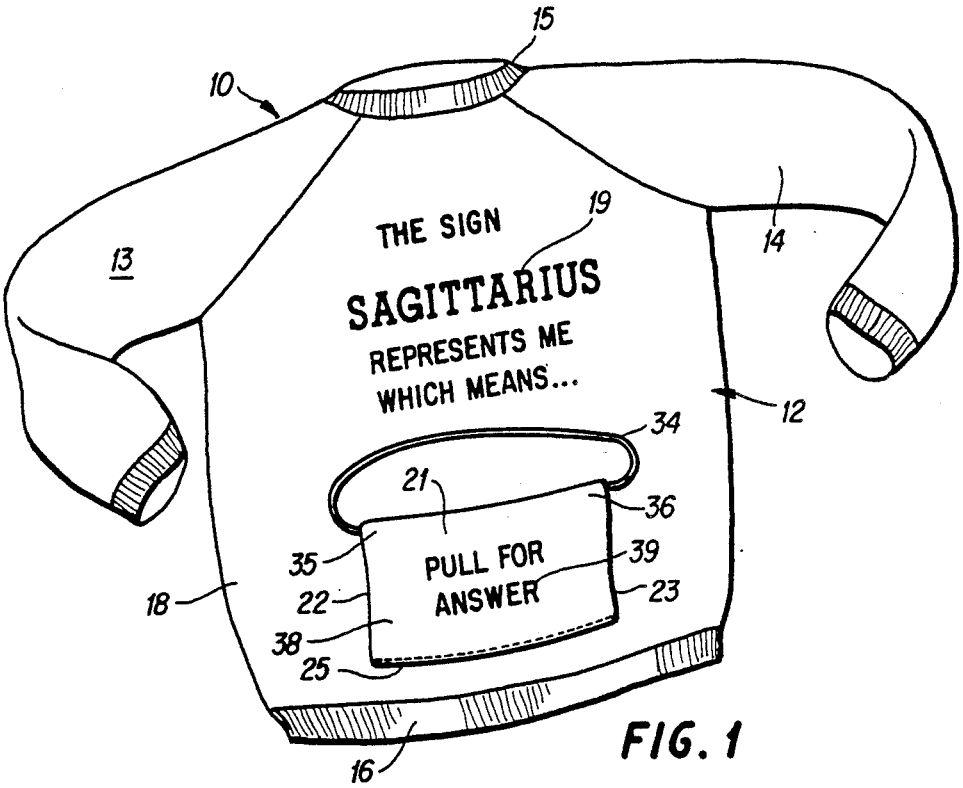
FIG. 1 is a planar view of a garment, in this case a shirt, having an inquiry and an answer with a flap positioned over the answer.

Referring now to the drawings there is shown a shirt, preferably a sweatshirt, designated generally by the numeral 10. While a sweatshirt is shown as indicative of the preferred embodiment, the garment may be any garment. The sweatshirt 10 has a front side 11 with a panel portion 12 generally disposed between sleeves 13 and 14, a collar 15 and a bottom edge 16. The panel 12 is divided into a first section 17 and a second section 18. The first section 17 includes indicia 19 thereon which, in the illustrated embodiment, is in the form of an inquiry. The second section 18 includes indicia 20 thereon which is in some way related to the indicia 19 of the first section. In the illustrated embodiment, the indicia 20 is an answer to the inquiry posed by the indicia 19.

As is seen in FIG. 1, the indicia 20 is covered by a flap 21 which has side edges 22 and 23, an upper edge 24 and a lower edge 25. The lower edge 25 is stitched to the lower section 18 of the panel 12 adjacent the bottom edge 16 of the garment 10 so as to be permanently attached to the garment at one edge. The panel 23 has an inside surface 27 to which is attached, by stitches, a pair of VELCRO pads 28 and 29 located adjacent the side edges 22 and 23 of the flap 21. A pair of complementary, identically spaced VELCRO pads 31 and 32 are attached to the second panel 18 of the shirt and have VELCRO hooks for coupling with the eyes of the VELCRO pads 28 and 29. A lanyard 34 is attached at its ends to the upper corners 35 and 36 of the flap 21. Preferably, the lanyard is of a different color than the flap 21 so as to be readily visible thereagainst.

The flap 21 has an exterior surface 38 which has indicia 39 thereon, which indicia instructs or suggests that the lanyard 34 be pulled in order to reveal the indicia 20 concealed behind the panel when the flap 21 is closed, as is seen in FIG. 1.

Figure 2:
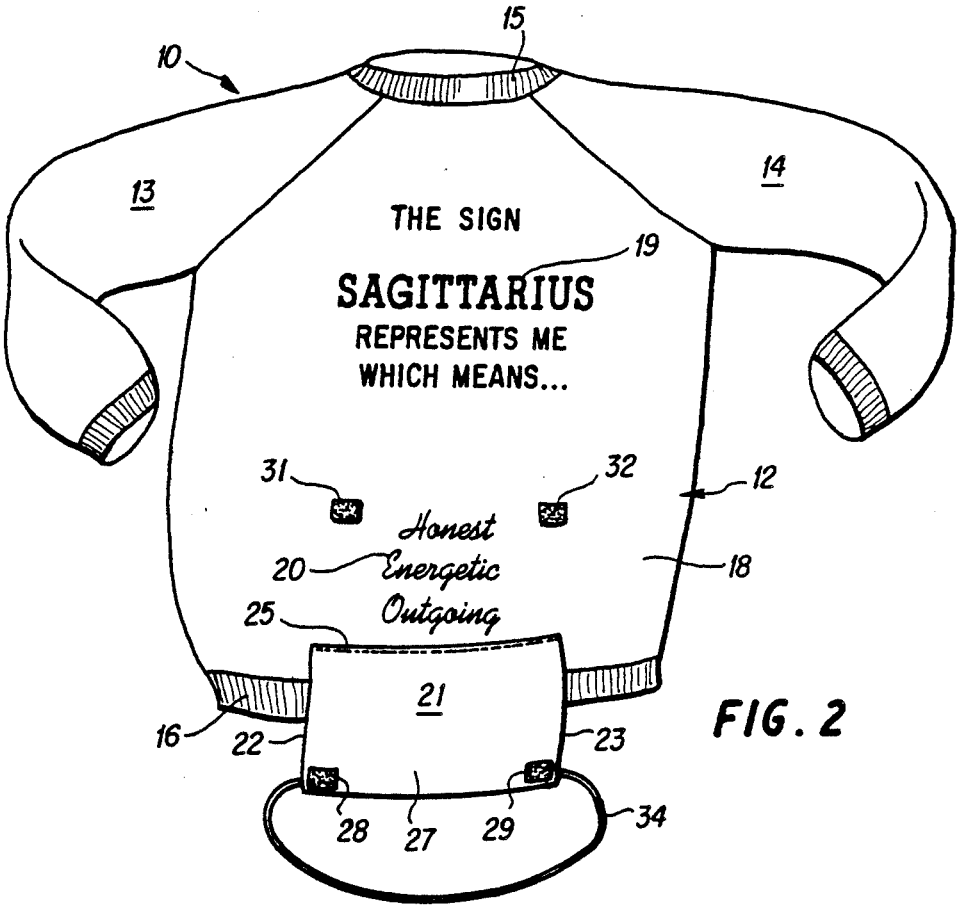
FIG. 2 is a view similar to FIG. 1 showing the flap pulled down to expose the answer to the inquiry.

It has been found that the particular arrangement set forth in FIGS. 1 and 2 provides an interesting garment which invites interaction between the person wearing the garment and other people and as such has resulted in a wide demand for shirts such as the shirt 10.

While the illustrated garment is in the form of a shirt 10 and while a shirt is the preferred garment, the principles of the instant invention may be applied to other garments, such as jackets and pants.

From the foregoing description, one skilled in the art can easily ascertain the essential characteristics of this invention, and without departing from the spirit and scope thereof, can make various changes and modifications of the invention to adapt it to various usages and conditions.

What is claimed is:

1. Novelty garment comprising:

a panel with an exposed surface, the panel being divided into first and second sections, first indicia on the first section;

second indicia on the second section, said second indicia bearing a relationship to the first indicia, and movable means for normally covering only the second indicia leaving the first indicia exposed, the movable means having third indicia thereon instructing an observer to move the movable indicia so as to expose the second indicia.

2. The garment of claim 1 wherein the garment is a shirt.

3. The garment of claim 2 wherein the indicia and movable means are on the front surface of the shirt.

4. The garment of claim 1 wherein the movable means is a flap having a first and second edges, the flap being secured to the garment adjacent to the first edge and including detachable fasteners adjacent to the second edge to hold the flap over the second indicia whereby, upon unfastening the fastening means, the second indicia is exposed.

5. The garment of claim 4 wherein a lanyard is attached to the flap adjacent the fastening means wherein pulling on the lanyard exposes the indicia beneath the flap.

6. A shirt comprising:

a front panel divided into an upper section and a lower section with first indicia on the upper section and second indicia on the lower section, the first and second indicia being related in meaning;

a flap having upper, lower and side edges, the flap being attached adjacent the lower edge thereof to the lower section of the shirt at a location beneath the second indicia, the flap including a lanyard attached thereto adjacent the upper edge and fastening means adjacent the upper edge for fastening the flap to the second section so as to cover the second indicia, the fastening means being detachable upon pulling the lanyard so as to expose the second indicia.

7. The shirt of claim 6 wherein the fastening means is comprised of complementary VELCRO patches secured to the flap as well as the shirt.

8. The shirt of claim 6 wherein the flap is made of a material different from the material of which the front panel of the shirt is made.

* * * * *